US005725106A

United States Patent [19]

Wilson

[11] Patent Number: 5,725,106

[45] Date of Patent: Mar. 10, 1998

[54] RACK APPARATUS FOR COMPOUND BOWS

[76] Inventor: William J. Wilson, 320 E. Aspen, Cottonwood, Ariz. 86326

[21] Appl. No.: 666,950

[22] Filed: Jun. 20, 1996

[51] Int. Cl.[6] ..... A47F 7/00

[52] U.S. Cl. ..... 211/13.1; 211/85.7

[58] Field of Search ..... 211/13, 60.1, 182, 211/85.7; 124/44.5, 41.1

[56] References Cited

U.S. PATENT DOCUMENTS 1,061,431 5/1913 West ..... 211/60.1 X 4,582,203 4/1986 Davis ..... 211/60.1 X 5,370,240 12/1994 Hand ..... 211/60.1 X 5,595,333 1/1997 Boston ..... 211/60.1 X

*Primary Examiner*—Alvin C. Chin-Shue

*Assistant Examiner*—Sarah L. Purol

*Attorney, Agent, or Firm*—H. Gordon Shields

[57] ABSTRACT

Rack apparatus for holding and supporting compound bows includes a generally horizontal holding element generally rectangular in configuration and secured to a base element which is of the same general configuration. The rack apparatus is padded for protecting the compound bows stored therein. The rack apparatus may be used in the field as well as in a vehicle and in a storage environment.

11 Claims, 2 Drawing Sheets

RACK APPARATUS FOR COMPOUND BOWS

BACKGROUND OF THE INVENTION

1. Field of the Invention

This invention relates to racks, and, more particularly, to racks for holding compound bows.

2. Description of the Prior Art

Unlike conventional bows, compound bows are not unstrung, but are left in a strung condition for storage and transport purposes. Accordingly, the compound bows need to be placed in a holder or rack which will support them in an appropriate manner. A number of different types of rack apparatus have been proposed for holding bows, but typically they have been for bows of the prior art, and few have been designed for holding compound bows.

Samples of holder apparatus for prior art bows include U.S. Pat. No. 223,667 (Church). This patent discloses a collapsible rack which holds a number of unstrung bows in a vertical and generally parallel orientation. The rack apparatus includes a number of slots and indentations for bows and arrows.

Another holder apparatus for bows and arrows is shown in U.S. Pat. No. 1,851,779 (Slater). The '779 Apparatus is a collapsible bow and arrow stand which is designed to be used in the field. It includes a shaft which extends vertically and is embedded in the ground. A transverse bracket holds the bow, while hooked elements hold elements.

U.S. Pat. No. 2,275,870 (Sheldon) discloses rack apparatus similar to that of the '779 Patent. The apparatus includes a shaft which is embedded in the ground and includes a holder bracket for a bow as well as brackets for holding arrows.

U.S. Pat. No. 2,593,789 (Pearson) is similar to both the '870 and '779 Patents. It also is designed with a shaft to be embedded into the ground, a bracket for holding a bow, and rack elements for holding arrows.

U.S. Pat. No. 3,221,957 (Roloff et al) discloses holder apparatus for arrows. The apparatus includes a canister for holding arrows and support elements for supporting the canister.

U.S. Pat. No. 3,256,872 (Koser) discloses a collapsible stand for holding a bow. The apparatus is in a general configuration of a tripod, with the lower portion of the bow comprising a third leg. The holder or stand apparatus of the '872 Patent includes two legs, and the bottom portion of the bow comprises the third leg of a tripod.

U.S. Pat. No. 3,584,820 (Butcher) discloses a holder for a bow and a holder for arrows. The apparatus includes a base, with a vertical element to which brackets are secured for the bow, and a quiver element also secured to the base. The apparatus may also be used as a support for a rifle.

U.S. Pat. No. 3,840,282 (Major) discloses a storage rack for hunting arrows. The apparatus is in the configuration of a cabinet, with pivoting door elements to provide access to a cabinet which holds arrows. A pair of brackets on one of the door elements holds a bow.

U.S. Pat. No. 3,926,393 (Tainsh) disclosed a collapsible bow and arrow stand which includes a tripod base and an element extending vertically upwardly from the tripod base. The vertical element includes a bracket which holds a bow and a quiver is fastened to the vertical element.

U.S. Pat. No. 4,360,179 (Roberts) discloses a stand for supporting a compound bow. The stand includes a pair of legs secured to a main stand portion, and the lower portion of the main stand portion comprises a third leg of a tripod. The compound bow is disposed against the main stand portion.

U.S. Pat. No. 4,474,296 (Hartman) discloses another stand for a compound bow. The apparatus includes a base and a vertical element extending upwardly from the base. The compound bow is disposed in a bracket secured to the vertical element. A quiver for arrows is also secured to the base and to the vertical element.

U.S. Pat. No. 4,542,873 (Matherly et al) discloses another holder for supporting a bow included is a bow supporting extension which is releasable and adjustably secured to a bracket.

U.S. Pat. No. 4,729,363 (Skyba) discloses a support element for a compound bow. The support element is secured to a tree stand. The apparatus includes a pair of bracket elements secured to the tree stand. One of the bracket elements extends downwardly from the tree stand and receives the bottom or lower portion of the bow, and the other bracket extends outwardly from the tree stand and supports the bow in an upright orientation.

None of the apparatus disclosed in the above noted patents are designed to hold a compound bow in a vehicle as well as in the field. The apparatus, as previously indicated, are primarily designed for the conventional bow, and few are designed for the compound bow. The support stands or racks designed for the compound bow are special purpose elements. The apparatus of the present invention comprises holder apparatus for a compound bow and the holder apparatus may be placed in a vehicle, in a room or shed, or in the field, as desired. The apparatus is easily transported and easily fabricated.

SUMMARY OF THE INVENTION

The invention described in claim herein comprises a generally rectangular horizontally extending form which is padded to receive a compound bow. The form is secured to a base which is of the same general configuration as the form. Several different embodiments are illustrated, including a collapsible stand which includes elements which pivot and fold for transport for storage purposes in which may be easily erected to hold a bow. The apparatus also includes a longitudinal member to divide the holder portion into two separate racks for holding two bows. Another embodiment of the apparatus includes telescoping members so that the height of the bow above the floor or ground may be adjusted, as desired.

Among the objects of the present invention are the following:

To provide new and useful rack apparatus;

To provide new and useful rack apparatus for compound bows;

To provide new and useful rack apparatus for supporting a pair of compound bows;

To provide new and useful rack apparatus for transporting compound bows;

To provide new and useful rack apparatus for holding compound bows in a vehicle while being transported and in the field between uses.

DESCRIPTION OF THE PREFERRED EMBODIMENT

Figure 1:
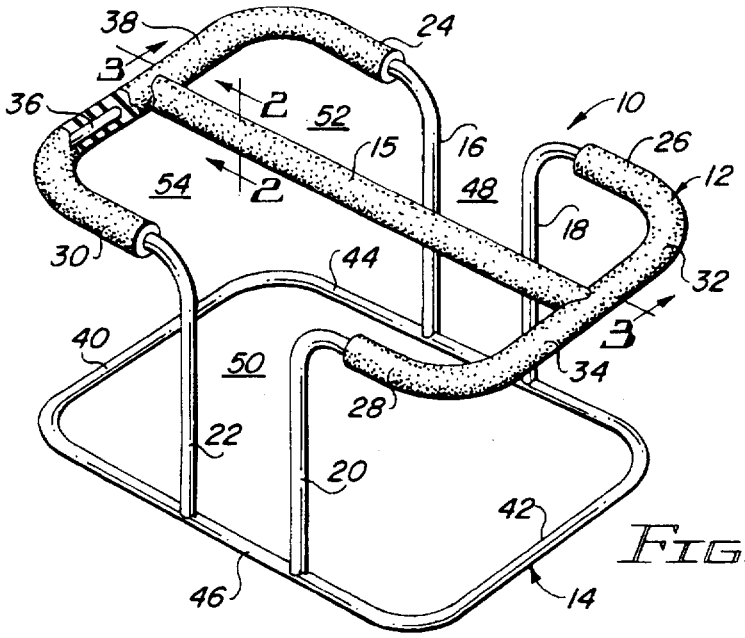
FIG. 1 is a perspective view of a rack apparatus for compound bows of the present invention.
Figure 2:
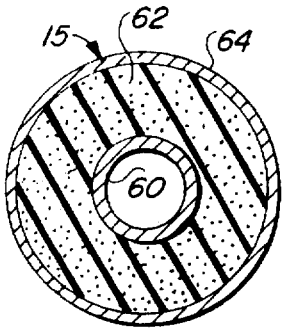
FIG. 2 is a view in partial section taken generally along line 2—2 of FIG. 1.
Figure 3:
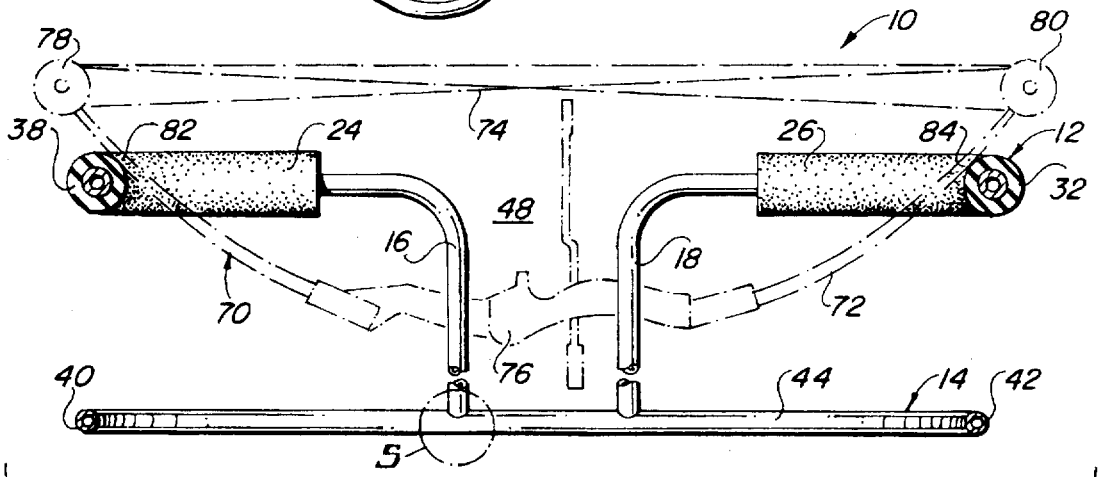
FIG. 3 is a view in partial section taken generally along line 3—3 of FIG. 1.
Figure 4:
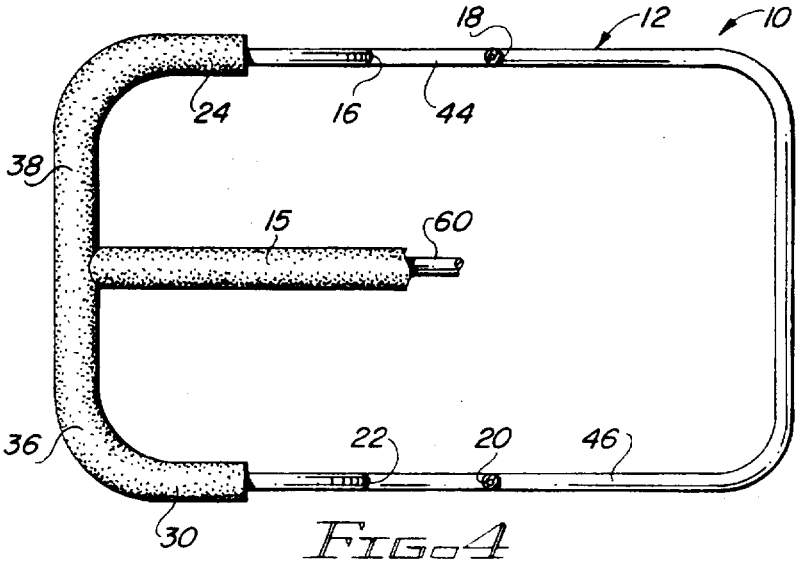
FIG. 4 is a top view, partially broken away, of the apparatus of FIG. 1.

FIG. 1 is a perspective view of a rack apparatus 10 for compound bows of the present invention. FIG. 2 is a view in partial section taken generally along line 2—2 of FIG. 1 through an upper portion of the apparatus 10. FIG. 3 is a view in partial section taken generally along line 3—3 of FIG. 1, with the apparatus 10 in a use environment, holding a bow shown in dash dot line. FIG. 4 is a top view of the apparatus 10 in partial section and partially broken away, taken in part generally along line 4—4 of FIG. 1. For the following discussion, reference will primarily be made to FIGS. 1–4, with specific reference as applicable.

The apparatus 10 comprises generally a holding element 12 for supporting a compound bow, and a base 14 for supporting the holding element 12. The entire apparatus has a generally rectangular form. The holding element 12 is generally rectangular in shape. It is shown being bisected along a lengthwise axis by a cross member 15, thus forming two distinct holding areas.

The base 14 is generally rectangular in shape. The base consists of two lower widthwise sections 40 and 42 and two lower lengthwise sections 44 and 46.

The holding element 12 is vertically supported by four support members 16, 18, 20 and 22. The four vertical support members extend upwardly from the two lower lengthwise sections, two on each side. Two support members extend upwardly from each of the longer sides of the base 14, and at a predetermined height meet the holding element 12.

The holding element 12 is divided into four top lengthwise members 24, 26, 28 and 30. The members 24 and 26 are aligned with each other and the members 28 and 30 are aligned with each other. These top lengthwise members 24, 26 and 28, 30 are each integral with and adjacent to the four vertical support members 16, 18 and 20, 22, respectively.

The holding element 12 also includes widthwise members 32, 34, 36, and 38, which are bisected by the cross member 15. The widthwise members are thus divided into four top widthwise members 32, 34 and 36, 38. These four top widthwise members are integral with and adjacent to and between the four top lengthwise members 24, 26 and 28, 30 and the cross member 15. It is these four top widthwise members which support the bow portion of a compound bow or bows when the apparatus is being used.

Intermediate the two top lengthwise sections of each lengthwise side of the holding element, i.e., between members 24 and 26 and between members 28 and 30, there are spaces or apertures 48 and 50. These apertures 48 and 50 are further defined by the vertical support members 16, 18, and 20, 22, respectively. The spaces or apertures serve to provide increased access to and manipulation of and compatibility with various compound bows and auxiliary accessories or peripherals being stored or transported.

Thus, in the holding apparatus 10, two distinct holding areas 52 and 54 are provided, each suitable for transporting or storing one or more compound bows and auxiliary accessories or peripherals.

In one embodiment, not shown, the horizontal holding element 12 may be able to be pivoted down or to the side. This will allow the rack to be compressed or collapsed for easy transport or storage when not in use. Similarly, the vertical supporting members can be hinged or telescoping. This will allow the height of the apparatus above the floor to be adjusted as desired. Other accessories to the apparatus might include straps and hooks and peripheral or integrally formed clamps.

In FIG. 2, the cross member 15 is shown in partial section showing the padded construction of the holding element 12 of the apparatus 10. The entire apparatus is constructed of suitably rigid materials and the holding element 12 has a softer, more resilient, padded layer over the rigid material of construction. Thus, a tubing member 60 is covered with a padded layer 62. The padding might also have a protective layer 64 to prevent degradation of the padding material or destruction by dirt, moisture, or through normal wear and tear and incidental damaging nicks, gouges, scratches or other minor accidents.

The holding element 12 is appropriately padded at points where there is any likelihood of the compound bow coming into contact with the rack and would primarily comprise of the four top lengthwise members 24, 26, and 28, 30, and the four top widthwise portions 32, 34 and 36, 38 and the cross member 15. The four vertically extending support members 16, 18 and 20, 22, as well as various portions of the lower base section 14 could also be provided with a padding and protective layer, if desired.

A compound bow 70 is shown only for representative reasons in FIG. 3, and is not a part of the present invention. Compound bows, in general include two portions, a bow portion 72 and a string portion 74. A handle 76 is disposed between and integral with the bow portion. A pair of pulley members 78 and 80 are secured at each end of the bow portion 72, and the string portion 74 is interlaced with the pulley members.

Rather than support a compound bow by the string portion 74, which could cause damage or soiling of the string or other portion, the rack apparatus 10 is designed to support compound bows by the bow portion. As shown, the bow 70 is supported at two support points 82 and 84.

The support points or areas 82 and 84 could actually be very large or broad, flat areas to provide a broader distribution of the weight of the bow on the holding element.

The function of aperture 48, defined by the vertical support members 16 and 18, now becomes apparent. Removal or installation of the compound bow 70 is facilitated and can be accomplished using the handle portion 76 of the compound bow, rather than by grasping and risking damage and soiling of the string portion 74. Furthermore, the aperture or space 48 is useful and necessary for accommodating the handle portion 76 as well as any peripheral accessories or other equipment being stored in or transported by the rack apparatus 10.

It will be understood from FIG. 4 that the general overall rectangular shapes of the holding element 12 and base 14 of the rack apparatus 10 for compound bows are both similarly dimensioned. However, the base 14 may be modified as to dimension and as to overall shape or configuration as long as it is able to support the holding element 12 and the items stored or transported therein. Similarly, the holding element 12 may be of different dimension and shape than the embodiment shown. The design constraints for the apparatus include having adequate dimensions for supporting compound bows, accessories and peripherals and an appropriate, efficacious and aesthetic shape.

In FIG. 4, the general alignment of the holding element or section 12 and the base 14 is shown. A portion of the holding element or section 12 is removed at about the center of the apparatus. Some of the padding of the cross member 15 is removed to show the tubing 60 and the general construction of the apparatus.

Figure 5:
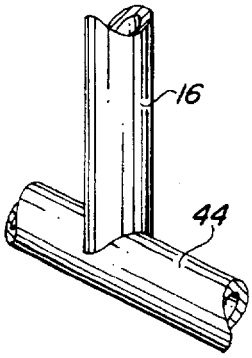
FIG. 5 is a view in partial perspective taken generally from circle 5 of FIG. 3.

FIG. 5 is a view in partial perspective taken generally from circle 5 of FIG. 3. This view of the construction design and detail of the rack apparatus 10 for compound bows is useful to understand the design requirements of the apparatus. A generally tubular material is employed for the overall material of construction, aside from the padding and protective layer of certain portions and sections of the apparatus, as discussed above.

At the juncture of two tubing sections or elements there is a connection of some sort, including welding, bonding, screws or bolts, or some other suitable connection means. Tubing construction is especially useful when large bows are stored or transported, as well as during transport when the rack and its contents may be subject to torsional and other strains and forces.

Figure 6:
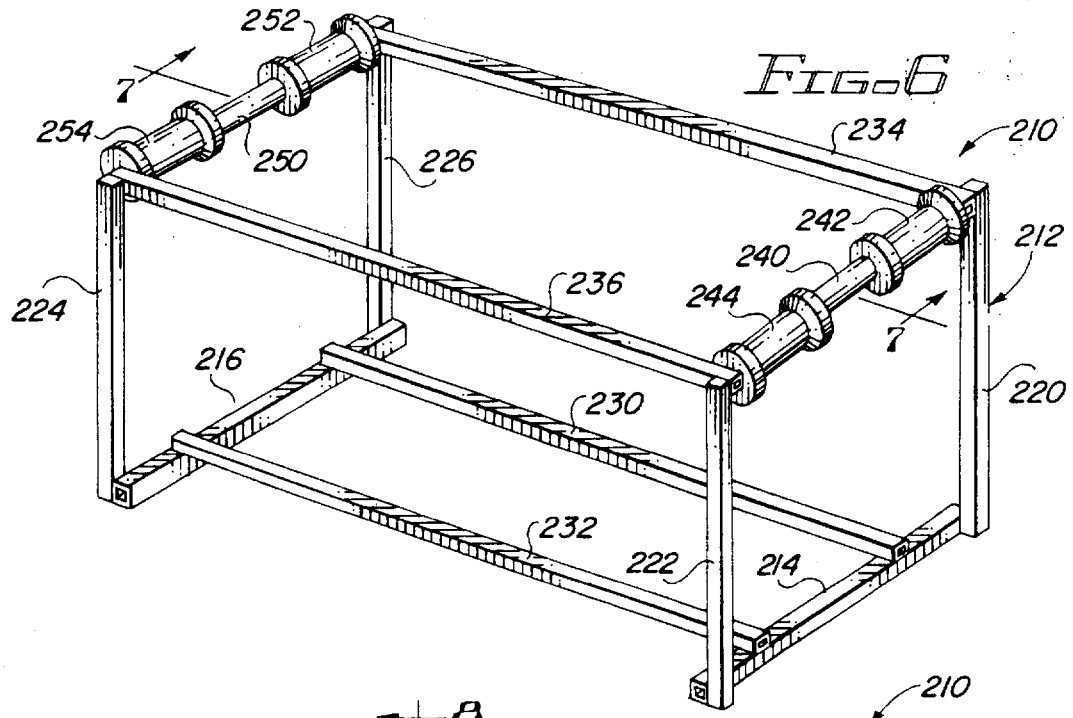
FIG. 6 is a perspective view of an alternate embodiment of the apparatus of the present invention.
Figure 7:
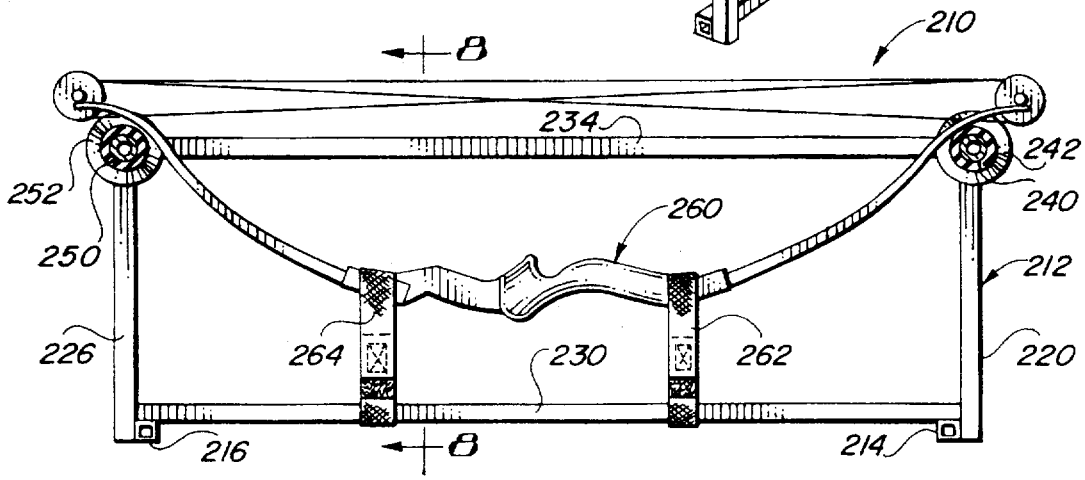
FIG. 7 is a view in partial section taken generally along line 7—7 of FIG. 6.
Figure 8:
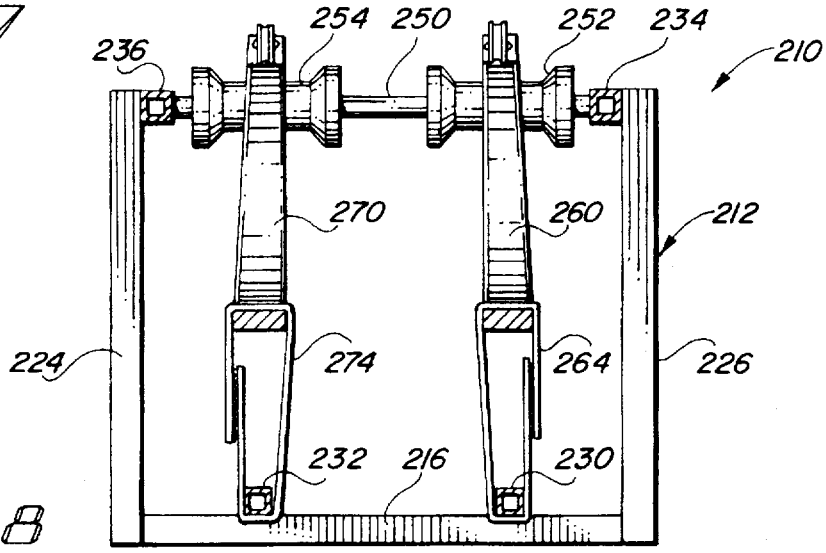
FIG. 8 is a view in partial section taken generally along line 8—8 of FIG. 7.

FIG. 6 is a perspective view of an alternate embodiment 210 of the rack apparatus of the present invention. FIG. 7 is a view in partial section through the rack apparatus 210 taken generally along line 7—7 of FIG. 6. FIG. 8 is a view in partial section of the rack apparatus 210 taken generally along line 8—8 of FIG. 7. For the following discussion, reference will generally be made to FIGS. 6, 7, and 8.

The alternate embodiment rack apparatus 210 includes a frame 212 which is generally made of square tubing, appropriately secured together, as by welding. The frame 212 includes a pair of base frame elements 214 and 216, which are appropriately spaced apart from each other and generally disposed parallel to each other.

Extending upwardly from the outer ends of the base elements 214 and 216 are vertical frame elements. The vertical frame elements include a pair of vertical frame elements or members 220 and 222 which extend upwardly from opposite ends of the base element 214. The vertical elements extending upwardly from the outer ends of the frame element 216 include vertical frame elements 224 and 226. The vertical frame elements or frame members 220, 222, 224, 226 are generally parallel to each other and are appropriately aligned.

A pair of longitudinal frame elements 230 and 232 extend between the base frame elements 214 and 216, to which they are appropriately secured, again as by welding. The frame members 230 and 232 are appropriately spaced apart from each other and are disposed inwardly from the outer ends of the frame members 214 and 226, and inwardly, or between, the vertical frame elements 220, 222 and 224, 226.

A pair of upper longitudinally extending frame members or elements 234 and 236 extend between, and are appropriately secured to, the vertical frame members 220, 226, and 222, 224, respectively. The outer ends of the frame members 224 and 236 are flush with the vertical frame members, just as the vertical frame members 220, 222 and 224, 226 are flush with the outer ends of the frame elements 214 and 216, respectively.

The frame members 234 and 236 are secured to the inner sides of their respective vertical frame members, as may be understood from both FIGS. 6 and 8.

Extending between the frame members 234 and 236 at the vertical frame members 220 and 222 is a rod or tubular member 240. Extending between the frame members 234 and 236 at the vertical frame members 226 and 224 is a rod or tubular member 250.

A pair of foam spool elements is disposed on the rod 240 and a pair of foam spool elements is disposed on the rod 250. The foam spool elements on the rod 240 include a spool element 242 and a spool element 244. On the rod or tubular member 250 is a foam spool element 252 and a foam spool element 254. The spool elements 242 and 252 are aligned with the bottom longitudinal frame member 230, while the spool elements 244 and 254 are aligned with the bottom longitudinal frame member 232. The alignment of the foam spool elements and the frame members 230 and 232 may best be understood from reference from FIG. 8.

The spool elements 242 and 252 are aligned with each other, as are the spool elements 244 and 254, to receive a pair of compound bows 260 and 270. The bow 260 is shown in FIG. 7, while both bows 260 and 270 are shown in FIG. 8.

The purpose of the bottom longitudinal frame members 230 and 232 is to allow a pair of straps to be secured to each bow to hold the bows in place, regardless of the orientation of the rack apparatus 210. In FIG. 7, a pair of straps 262 and 264 is shown securing the bow 260 to the bottom longitudinal frame member 230. In FIG. 8, a strap 274 is shown securing the bow 270 to the frame member 232.

The foam spools provide cushion for the ends of the compound bows 260 and 270, while the straps, disposed about the bows and the longitudinal frame members, provide sufficient cushioning action to insure that the bows are not damaged.

It will be understood that the rack apparatus for compound bows of the present invention can be mounted permanently or removably to storage vehicles or other objects, such as walls, doors, ceilings, or anywhere else one would desire such an apparatus. The apparatus may be equipped with straps or clamps or padded mounting blocks or contact points for fixing it to a vehicle or other structure. It will become apparent to one skilled in the art that there are many alternate means for attaching or mounting the apparatus to a vehicle or structure and these means may provide a permanently fixed, removable or locking apparatus.

Additionally, the apparatus could be used freestanding, such as in a closet, or it could be mounted to a wall or vehicle or other surface as desired using the structure attaching means. Moreover, the base elements provide a sufficient footprint to allow the apparatus to be disposed in the field, and even on relativley soft ground, and still provide a stable support rack for compound bows.

The materials of the apparatus must be chosen with care so as to provide appropriate and suitable protection, rigidity and overall integrity. Finally, the apparatus might be equipped with clamps or straps or other means for attaching accessories or peripheral equipment to the rack apparatus. This would allow transport or storage, efficiently and economically, of compound bow arrows, quivers, hand gloves, hand and arm braces, etc. These accessory attaching means would include rubber straps, slots or holes, clamps, ties, etc.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, within the limits only of the true spirit and scope of the invention.

What I claim is:

1. A rack apparatus for storing and transporting compound bows comprising in combination:

a pair of generally horizontal and spaced apart holding members for providing direct contact support for a compound bow;

a base connected to the holding members for supporting the holding members to protect the compound bow while being stored and transported;

a longitudinal element secured to the base and beneath the bow disposed on the pair of holding members; and means for securing the bow to the longitudinal element during storage and transport.

2. The apparatus of claim 1 in which said holding members are padded to protect the compound bow being stored and transported on the rack apparatus.

3. The apparatus of claim 1 in which the base is connected to the holding members by a plurality of generally vertically extending support members.

4. The apparatus of claim 3 in which the support members include a first pair secured to one holding member of the pair of holding members and a second pair secured to the other holding member of the pair of holding members.

5. The apparatus of claim 4 in which the first and second pairs of support members are spaced apart to provide an aperture for facilitating installation and removal of the compound bow from the holding members.

6. The apparatus of claim 1 in which the base comprises a plurality of support members thereby maintaining the holding members in a predetermined orientation relative to the base.

7. The apparatus of claim 1 in which said holding members are bisected by a cross member, thereby forming a plurality of distinct holding areas for holding a plurality of compound bows.

8. The apparatus of claim 1 in which the means for securing the bow to the longitudinal element comprises a pair of straps.

9. The apparatus of claim 1 which further includes a spool element on each of the holding members and on which the bow is disposed for cushioning the bow.

10. The apparatus of claim 9 in which the spool elements are made of foam material.

11. The apparatus of claim 1 in which the base comprises a generally rectangular base, and the pair of holding members are connected to the base by support members extending between the base and the holding members, and the holding members are connected to each other by longitudinally extending elements, and the holding members and the longitudinally extending elements comprise a generally rectangular configuration generally parallel to the base.

* * * * *